United States Patent [19]

Hagino

[11] Patent Number: 4,718,586

[45] Date of Patent: Jan. 12, 1988

[54] SWIVEL FASTENING DEVICE

[76] Inventor: Kiyohiko Hagino, 2-2-11 Nishitomi, Fujisawa-City, Kanagawa Prefecture, Japan

[21] Appl. No.: 894,619

[22] Filed: Aug. 8, 1986

[51] Int. Cl.[4] ..... A45F 5/00

[52] U.S. Cl. ..... 224/252; 224/197; 224/269; 224/914

[58] Field of Search ..... 224/197, 269, 914, 196, 224/240, 242, 252, 271, 272; 455/351; 24/669, 702

[56] References Cited

U.S. PATENT DOCUMENTS

| | | | |
|---|---|---|---|
| 3,743,147 | 7/1973 | Wilczynski | 455/351 X |
| 3,878,589 | 4/1975 | Schafer | 224/269 X |
| 4,485,946 | 12/1984 | Liautaud et al. | 224/197 X |

*Primary Examiner*—Stephen Marcus

*Assistant Examiner*—David Voorhees

[57] ABSTRACT

Improvements in swivel fastening devices for removably connecting two objects together in such manner that, once the connection is made, the objects may swivel with respect to one another to a considerable degree without detachment from one another; a swivel attachment involving a belt carried element which is removably engageable with a case carrying element, the case carrying element engageable and disengageable with the belt carrying element only when the case is in a vertical, inverted position, all other engaged positions retaining a solid interconnection between the belt element and the case element; a case element having an enlarged headed post and two spaced apart pins thereon engageable with two channels in a belt carried element operable to provide a swivel attachment effective over a large arcuate angle.

9 Claims, 11 Drawing Figures

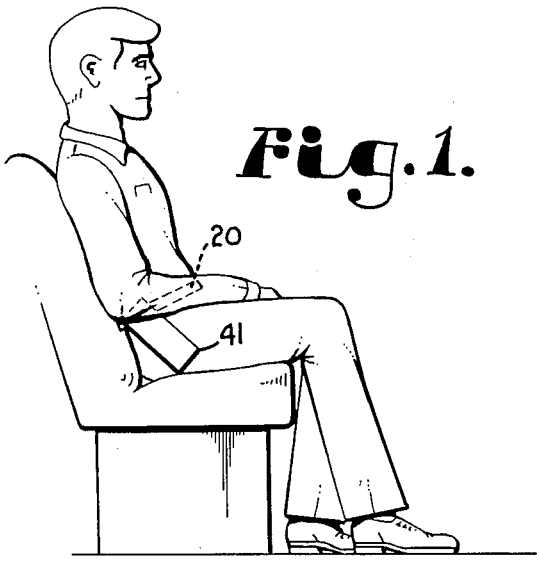
Fig. 1.
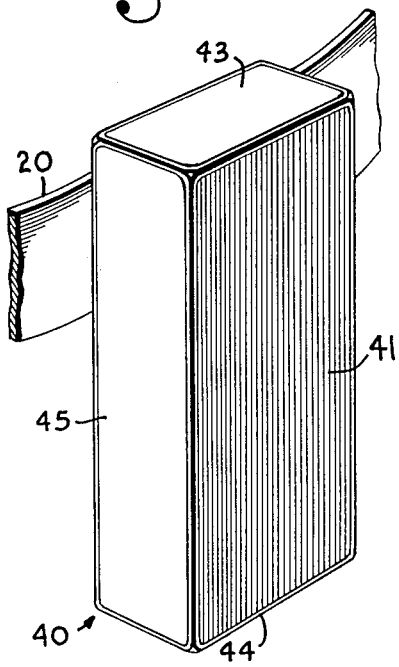
Fig. 2.
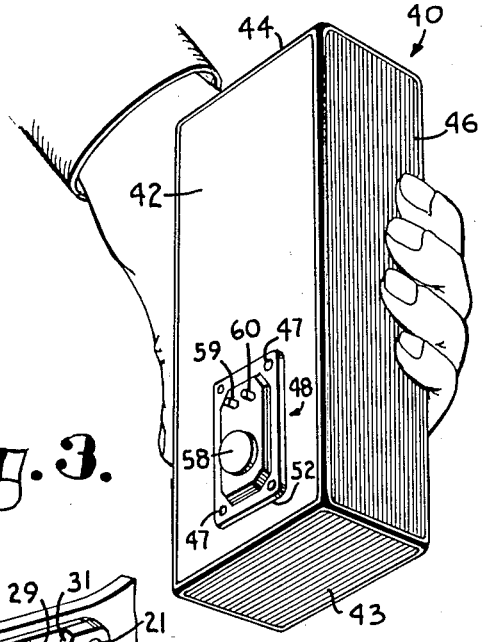
Fig. 3.
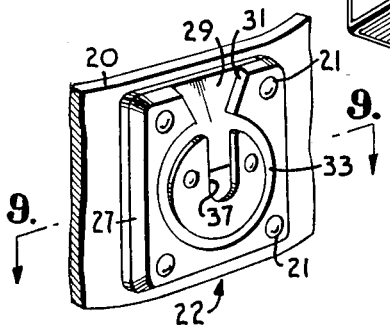
Fig. 4.
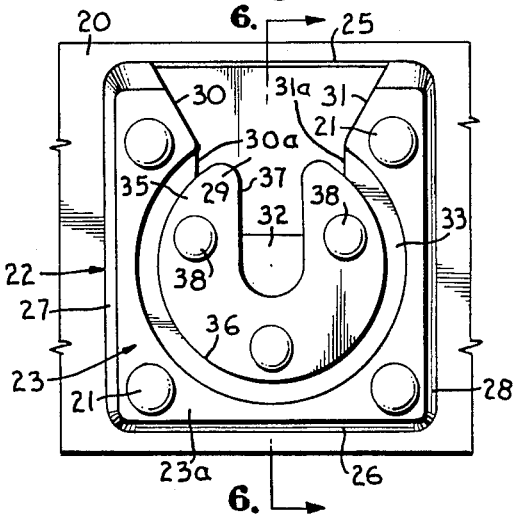

SWIVEL FASTENING DEVICE

BACKGROUND OF THE INVENTION

Certain individual or personal use devices are commonly carried on a person's belt in order that the device is immediately present when needed. Such belt carried devices commonly have carrying cases which themselves must be supported by the belt worn by the user. Personal radio receivers are an example of such a device.

With respect to a personal radio receiver carrying case, such should be easily and quickly attachable to and also readily detachable from the belt. The connection between the case and the belt should be such as to be personally comfortable to the user or wearer.

Elongated devices which are belt supported usually require pivotal mountings so that, when the user sits down, the lower end of the device will not engage the seat. This sort of action requires a connection which not only permits attachment and detachment at will, but also arcuate or pivotal movement over a considerable angular distance which retaining attachment and securement to the belt.

THE PRIOR ART

I am personally aware of two United States patents which are directed to the particular problem with which my own invention is involved. These are Wilczynski U.S. No. Pat. 3,743,147 issued July 3, 1973 for "Support For Carrying Case" and Schaefer U.S. No. Pat. 3,878,589, issued Apr. 22, 1975 for "Separable Fastening Device". I am also aware of the following patents for separable fastening devices for various constructions and applications where coupling and uncoupling of fasteners or connectors are involved:

Guerrant U.S. Pat. No. 491,551 "Pump Rod Coupler", issued Feb. 14, 1983;

Rohrs U.S. Pat. No. 2,049,860 "Button", issued Aug. 4, 1936;

Saathoff U.S. Pat. No. 2,449,722 "Bank Or Jewelry Box", issued Sept. 21, 1948;

Jasper U.S. Pat. No. 2,658,650 "Fishing Rod Holder", issued Nov. 10, 1953;

Goldman U.S. Pat. No. 3,117,708 "Positioning Swivel For Revolver Holsters", issued Jan. 14, 1964;

Horne U.S. Pat. No. 3,261,519 "Rotary Holster Mounting" issued Jul. 19, 1966;

Ishizaka U.S. Pat. No. 3,583,042 "Fastener", issued Jun. 8, 1971;

Collins U.S. Pat. No. 3,797,717 issued Mar. 19, 1974 for "Stethoscope Receptacle".

OBJECTS OF THE INVENTION

A first object of the invention is to improve over the devices shown in U.S. Pat. Nos. 3,743,147 to Wilczynski and Schaefer 3,878,589 with respect to supports for carrying cases and separable fastening devices.

Another object of the invention is to provide an improved connect/disconnect device for belt worn carrying Another object of the invention is to provide a quick connect/disconnect device for belt worn carrying cases wherein a maximum angular displacement of the carrying case may be effected without causing or permitting a disconnect. Another object of the invention is to provide a strong, dependable connect/disconnect device for belt worn carrying cases wherein the device itself is of relatively simple construction and economical to manufacture, as well as of long life under hard use.

Other and further objects of the invention will appear in the course of the following description thereof.

THE DRAWINGS

In the drawings, which form a part of the instant specification and are to be read in conjunction therewith, an embodiment of the invention is shown and, in the various views, like numerals are employed to indicate like parts.

FIG. 1 is a side view of a seated man with a cased device or artifact being belt suspended with respect to his clothing, the elongate case being shown canted from vertical with respect to the belt engagement as permitted by the subject device.

FIG. 2 is a three-fourth perspective view slightly from above of a cased device or artifact suspended or mounted with respect to a belt by the subject device (not seen).

FIG. 3 is a view showing the case of FIG. 2 (in the right hand side of the view) inverted and with the opposite side thereof shown (from that seen in FIG. 2) prior to engagement of the half of the mounting device on the case with the half of the mounting device on the belt, the latter shown in the lower left hand part of the view of FIG. 3.

FIG. 4 is an enlarged front view of the belt mounted portion of the engaging device comprising the subject invention.

Figure 5:
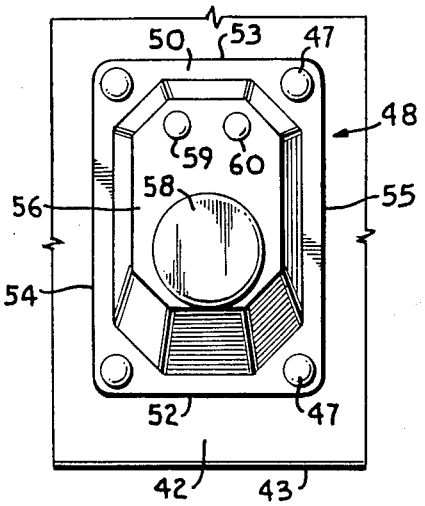
FIG. 5 is an enlarged frontal view, inverted, of the part of the engaging device which is received on the upper portion of the case, this view being like that seen in the right hand side of FIG. 3 except enlarged and directly frontal.

Referring to the drawings, at 20 is depicted a belt having secured thereto, by rivets or other conventional attachment means 21, a belt element generally designated 22. Belt element 22 is seen in the lower left hand corner of FIG. 3, in FIG. 4, in FIG. 6, in the left hand side of FIG. 8, in FIG. 9 and in full lines in FIGS. 10 and 11. Belt element 22 is preferably of substantially rectangular form with front and rear faces 23 and 24 and top 25, bottom 26 and side 27 and 28 edges.

The base plate rear plate is preferably substantially flat. The base plate front face is complexly configured as will now be described. The outer portion **23*a* of the front face is preferably flat and extends substantially parallel to the base plate rear face 24 except centrally of the top edge of the front face, which portion 29 is relieved in a part thereof at least to a first fixed depth. As may be seen in the upper portions of FIGS. 4, 10 and 11 (also the upper portions of FIGS. 6 and 8), the recessed or relieved central top portion 29 is preferably outwardly divergent from below or inwardly divergent from the top as effected by walls 30 and 31. Likewise, the relieved portion 29 is beveled, preferably, from a greater depth at the top end 25 downwardly as seen in FIGS. 6 and 8**.

A first, continuous channel 29, 32 is formed in said front face at least to said first fixed depth as represented in the bottom portion 32 thereof, said channel extending from the front face top edge 25 downwardly into and centrally of the front face. A second circular shaped channel 33 is formed in said front face to at least a second lesser depth than at 32 (and preferably the same depth as at 32) in such a fashion as to extend peripherally of said first channel in at least the lower portions thereof, second channel 33 connecting into said first channel in the upper end portions thereof. The second channel 33 has inner and outer walls thereto (unnumbered).

Figure 6:
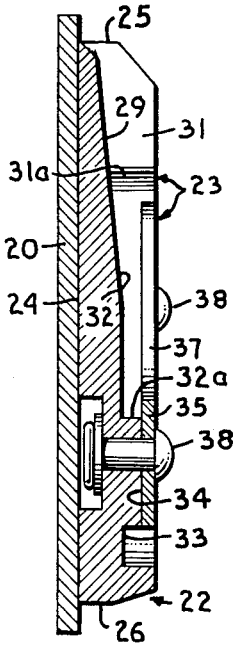
FIG. 6 is a view taken along the line 6—6 of FIG. 4 in the direction of the arrows.
Figure 8:
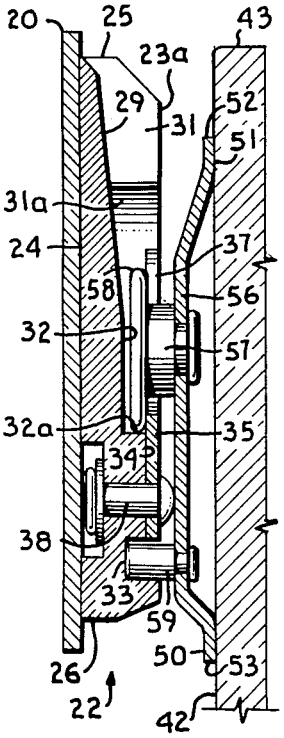
FIG. 8 is a view like that of FIG. 6 (on the left hand side of the view) with the device of FIG. 7 engaged therein and inverted from the view of FIG. 7. This is also the position of the view of FIG. 11.
Figure 9:
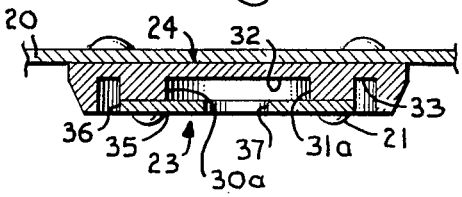
FIG. 9 is a view taken along the line 9—9 of FIG. 3 in the direction of the arrows.

The portion of the front face 23 that is positioned between the first and second channels is somewhat recessed as seen at 34 in FIGS. 6 and 8. Plate 35 having a substantially circular outer edge 36 and upper center slot 37 is fixed to said recessed portion 34 by rivets 38.

Parallel wall portions 30*a* and 31*a* are overlaid in the lower portions thereof (FIGS. 4, 10 and 11) by the inwardly extending parallel edges of plate 35 where it forms slot 37, the rounded bottom portion of slot 37 also overlying upwardly and inwardly of the bottom end 32*a* of the first channel 29, 30, 31, 30*a*, 31*a* and 32 as seen in FIG. 8 and FIG. 6. The outer periphery 36 of plate 35 defines a trackway with the second channel inner wall by comprising in itself an upward extension of the said second channel inner wall as may be seen in FIGS. 6 and 8. Thus, in contrast, the lower wall portions of the first channel at 30*a*, 31*a* and 32*a* have continous portions of plate 35 both overlying and extending inwardly thereof, while the outer periphery 36 of the plate 35 is aligned, most preferably, with the face of inner wall of the second channel 33.

Figure 10:
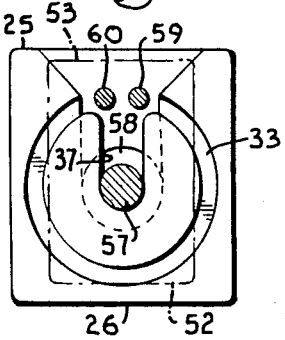
FIG. 10 is a front view of the device of FIGS. 3 and 4 (lower left hand corner of FIG. 3) with the case engaging device shown in dotted lines in inverted form as in FIG. 7 before rotation into engagement with the belt half of the device.
Figure 11:
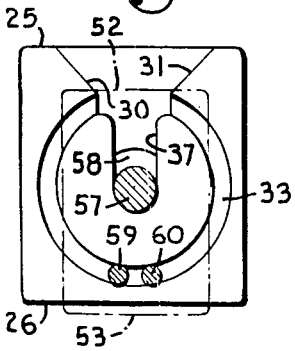
FIG. 11 is a front view of the device of FIG. 10 with the case carried member rotated 180 degrees from the position of FIG. 10 into engagement with the parts in the position of FIG. 8.

In the views there is additionally shown a case 40 having front side 41, rear side 42, top wall or side 43, bottom wall or side 44 and side walls 45 and 46. Fixed to the top portion of the rear or backside wall 42 by rivets, studs or other connectors 47 is a case element or connector generally designated 48. The case element or connector 48 is specifically shown in the center right hand portion of FIG. 3 (in inverted position), in FIG. 5 (in inverted position), in FIG. 7 (in inverted position) and in FIG. 8 in upright position engaged with the belt element previously described. This device is also seen in FIGS. 10 and 11 in dotted lines in abstract form.

Case element 48 has front and rear sides 50 and 51, top edge 52, bottom edge 53 and side edges 54 and 55. Case element 48, as illustrated, is preferably substantially rectangular in shape. If the case element is basically a metallic plate, which is preferred, it may be centrally outwardly dished as at 56, the surrounding base level periphery typically carrying the openings for emplacing rivets.

Said case element has a round post 57 fixed to the upper central portion of element 48, post 57 having a round, large diameter, substantially flat head 58 thereon. Element 48 also has two lesser diameter posts, pins or pegs 59 and 60 fixed to the front sides thereof spaced downwardly and symmetrically away from said post 57. Pins 59 and 60 are substantially separated from one another and are substantially the same height as the top of head 58.

The body of belt element 22 may conveniently be molded of plastic with the plate 35 conveniently being of metal. The case element 28 is most conveniently formed of metal in the parts thereof.

It may be seen from this description that the device of interest comprises a first belt member 22 having an open ended slotted cavity 29, 32 and a circular groove 33 formed in the face thereof, there being a cooperating second case member 48 having two projecting pins 59 and 60 and a third larger proJection 57 with an enlarged head portion 58 thereon which third projection may be slid into and retained within the slotted cavity of the first member. The pins or pegs are spaced from the large headed projection a distance equal to the radius of the circular groove 33 about the lower end of the slotted cavity 32 in the first or belt member and prevent the headed projection from sliding out of the cavity 29, 32 except when the two members or pins are oriented such that they are clear of the groove, that is, aligned with the slot 29, 32 and above it (FIG. 10).

With the first member 22 so attached to a belt 20 and the second member 48 to an article 40 to be carried on the belt (such as a portable radio transceiver), the article 40 so mounted will normally hang upon and pivot about the headed projection 57, 58, but may be removed from the belt 20 upon inverted orientation and upward movement of the case 40 in inverted position.

In operation of the device, it is first assumed that the carrying case 40 is disengaged from the belt 20 and that it is desired to mount the carrying case 40 on belt 20 by mating the connector parts or elements of the belt element 22 and case element 48. As has been described, the belt element 22 is mounted on a belt 20 with the top edge 25 extending upwardly and the bottom edge 26 extending downwardly, assuming the belt itself is in a horizontal position as would be the case in the normal standing position of an individual and substantially the case in a normally seated individual. In FIG. 3, there is shown a separate case 40 in inverted position with respect to a belt element 22 on a belt in normal position, as described.

What is desired to be done is to pass the enlarged round head 58 on post 57 into the top central passageway portion 29 between walls 30 and 31 with the pins 59 and 60 vertically positioned above post 57 so that they also will then be passed into passage 29 between walls 30 and 31. As the enlarged round head 58 is placed into contact with the beveled channel portion 29 between walls 30 and 31, it is then moved vertically downwardly so that the enlarged flat head portion 58 passes under the slot 37 inward edges of metallic piece 35 positioned between walls 30*a* and 31*a*. The post 57 extends outwardly through slot 37 while the enlarged head 58 is captured under the slot edges 37. When the periphery of round flat head 58 is against the base 32*a* of flat slot portion 32, the pegs or pins 59 and 60 are radially or arcuately such a distance away from the center of post 57 that rocking or rotation of the case 40 from its vertical position will cause the pins or pegs 59 and 60 to pass into second channel 33.

The outer diameter of post 57 is preferably only slightly less than the distance between the opposed walls of slot 37 so that, when the enlarged head 58 is seated as seen in FIGS. 8, little lateral motion with respect to post 57 in slot 37 can take place. It is also desired that the outer diameter of the enlarged flat head 58 be substantially equal to the distance between walls 30*a* and 31*a*, whereby not only is enlarged head 58 received fully under the inner edges of metallic piece 35, but, also, there can be little working of enlarged head 58 (save rotation) in the slot portion represented by walls 30*a*, 31*a* and 32*a*.

The provision of two pins or pegs 59 and 60, such spaced apart a distance substantially equal to the diameter of enlarged flat head 58 prevents working of the engaging means (post 57, head 58 and pins 59 and 60) in slot 37 and the channel defined by walls 30*a*, 31*a* and 32*a* during the entire rotational engagement of the two pegs or pins in slot 33. That is, the case element 48 will remain firmly engaged with respect to said belt element 22 over an arc of well over 180 degrees, specifically, at least the arcuate rotation wherein both of the pins or pegs 59 and 60 are engaged in channel 33. In point of actual fact, a positive, nonworking or nonsliding engagement is possible until the last pin comes out of the channel 33 on either side thereof because the paired pin engagement all the way around channel 33 prevents the central portion (post 57 and head 58) from moving upwardly in slot 37 at all other positions.

Figure 7:
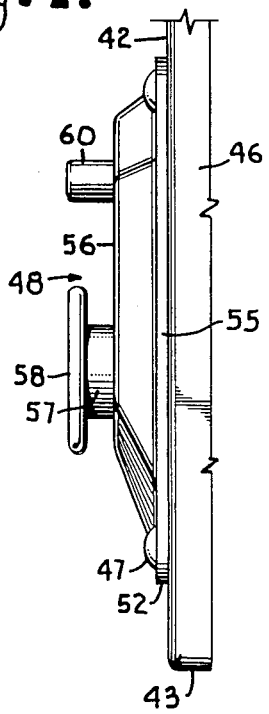
FIG. 7 is an enlarged side view of the device of FIG. 5 taken from the right hand side of that view looking to the left in the view of FIG. 5.

FIGS. 6 and 7 taken together show the belt element 22 on the left and the case element 48 on the right with the case element in a near pre-engagement approach to the belt element. In the two views, the downwardly extending flange of enlarged flat head 58 (FIG. 7) is shown extending below the top end of the slot 37 FIG. 6 and thus case element 48 is positioned just a little low for the initial engagement. FIG. 8 shows the complete mating of the engaging parts with post 57 in slot 37, the enlarged head 58 abutting against base wall 32*a* of the first channel portion 30*a*, 31*a* and pins or pegs 59 and 60 received in second channel 33 adjacent to bottom wall 26 of the belt element 22. FIG. 8 corresponds to FIG. 11 with pins or pegs 59 and 60 at the bottom of second channel or slot 33, while FIG. 10 approximates the immediate aftermath of joining FIGS. 6 and 7 as the post 57 is slid to the bottom of slot 37 in member 35, the pins 60 and 59 not yet being pivoted (either to the left or to the right in the view of FIG. 10) into engagement with channel 33.

To disengage the belt element and case elements, the process is reversed. Assuming starting from the position of FIG. 8 with the engaging parts of the belt and case elements fully engaged, the operator or user must rotate the case element 48 (by manipulating the case to which it is attached) from the position of FIG. 11 to the position of FIG. 10. When it is seen in FIG. 10 that either pin 60 or 59 may be swiftly engaged in channel 33 by left or right pivoting from the inverted vertical insert position, it may also be seen that there is over a 270 degree arc of full engagement by the subject device before release is possible. Starting, then, from the FIG. 11 and FIG. 8 positions, the case 40 and case element are rotated around post 57 and flat head 58 180 degrees to the position of FIG. 10 with both pins or pegs 59 and 60 clear of channel 33 and directly above slot 37. At this point, with the pins 59 and 60 being free of channel 33, the case element 48 may be lifted out of engagement with the belt element 22 with post 57 sliding up slot 37 and then out through the outwardly diverging (upwardly) walls 30 and 31. Pins 59 and 60 must be sufficiently far apart with respect to the arcuate curvature of channel 33 (circular) that any force attempting to remove post 57 from slot 37 and head 58 from under the inward walls of slot 37 will cause the lower one of said pins to contact the inner wall of channel 33. Pins 59 and 60 preferably are far enough apart that they would not fit downwardly within slot 37 and each one is substantially closely or adjacently positioned to channel 33 when the case element is in the position of FIG. 10.

There is a very precise pattern of geometrical relationships that are required in this device. For example, when the enlarged head (circular member 58) is seated at the bottom of the first channel defined by walls 30*a*, 31*a* and 32*a*, the centers of pins 59 and 60 are positioned a distance away therefrom equal to the distance away of the center of second channel 33 from the center of head 58. Also, the pins 59 and 60 are spaced far enough apart that, when the case element is swiveled, the lower pin is always forced into contact with the inner wall of channel 33 by the upper pin being forced into contact with the outer wall of the channel 33.

From the foregoing, it will be seen that this invention is one well adapted to attain all of the ends and objects hereinabove set forth together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. A belt support for a carrying case comprising, in combination:

(1) a belt element comprising a base plate of substantially rectangular form with front and rear faces, top, bottom and side edges, the base plate rear face being substantially flat, the base plate front face being configured as follows:

the outer portion of the front face being flat and substantially parallel to the base plate rear face except centrally of the top edge of the front face, which portion is relieved in a part thereof to a first fixed depth, a first, continuous channel being formed in said front face at least to said first fixed depth extending from the front face top edge relieved portion downwardly into and centrally of the front face, a second circular shaped channel formed in said front face to at least a second lesser depth and extending peripherally of said first channel in at least the lower portions thereof and connecting into said first channel in the upper portion thereof, said second channel having inner and outer walls, the portion of the front face between the first and second channels being somewhat recessed, a slotted plate fixed to said recessed portion of the front face between the first and second channels, the slot in said plate leaving portions of the plate extending inwardly of and overlying the peripheral limits of said first channel, the periphery of said plate defining a trackway with said second channel outer wall, and (2) a case element, said case element having front and rear sides thereto and being substantially rectangular with top, bottom and side edges, said case element having a post with a round, larger diameter, substantially flat head thereon positioned substantially centrally of the front side thereof, said case element also having two pegs positioned on the front side thereof spaced downwardly and symmetrically away from said post and also substantially separated from one another, the round, flat head of the post on said case element being receivable in and moveable the length of said first channel with the edge of said round flat head received under the plate extensions over said first channel and being rotatable therewithin with said case element when said round flat head is at the base of the first channel, the pegs receivable in the second channel and trackway when the round flat head of the post is at the base of the first channel, upon rotation of the case element with respect to said belt element towards a position where the case element top edge and belt element top edge are in alignment, the pegs and the round flat headed post working in the two channels to retain the case element and belt element in rotational engagement for an arc of over 180°.

2. A device as in claim 1 including openings through the corners of the case element and belt element for attachment of same to cases and belts.

3. A belt support as in claim 1 including means associated with said case element for fastening same to a case.

4. A belt support as in claim 1 including means associated with said belt element for securing same to a belt.

5. A belt support as in claim 1 wherein said pegs are separated a sufficient distance from one another that the round flat head on the post will not move substantially upwardly in the first channel at any point in the rotation of the case element with respect to said belt element so long as both posts are within the trackway.

6. A belt support as in claim 1 wherein the flat headed post and pegs are positioned on an outwardly dished portion of said case element.

7. A belt support as in claim 1 wherein the portion of said first channel extending out of the top edge of the base plate is outwardly divergent, whereby to lead the round flat head of the post into and under the edges of the slot in the plate fixed to said base plate.

8. A belt support as in claim 1 wherein the first continuous channel is beveled upwardly and inwardly from the top outer edge thereof towards the slot in said plate.

9. A belt support as in claim 1 wherein said second circular shaped channel is formed in said front face to a second lesser depth than the lead in portion of said first channel but to a depth substantially equal to the depth of the portion of the first channel where the round flat head of the post is fully seated within said first channel.

* * * * *